US008876362B2

(12) United States Patent
Nguyen

(10) Patent No.: US 8,876,362 B2
(45) Date of Patent: Nov. 4, 2014

(54) NAIL POLISH DISPLAY SYSTEM

(76) Inventor: Cuong Nguyen, Seattle, WA (US)

( * ) Notice: Subject to any disclaimer, the term of this patent is extended or adjusted under 35 U.S.C. 154(b) by 968 days.

(21) Appl. No.: 13/005,424

(22) Filed: Jan. 12, 2011

(65) Prior Publication Data

US 2012/0041589 A1 Feb. 16, 2012

Related U.S. Application Data

(60) Provisional application No. 61/372,531, filed on Aug. 11, 2010.

(51) Int. Cl.

| | |
|---|---|
| ***B01F 15/00*** | (2006.01) |
| ***A47F 3/08*** | (2006.01) |
| ***A47F 7/28*** | (2006.01) |
| *A45D 34/00* | (2006.01) |
| *A45D 44/00* | (2006.01) |

(52) U.S. Cl.

CPC . *A47F 3/08* (2013.01); *A47F 7/283* (2013.01); *A45D 34/00* (2013.01); *A45D 44/00* (2013.01)

USPC ..... 366/143; 366/208; 366/213

(58) Field of Classification Search

USPC ..... 366/143, 208, 213

See application file for complete search history.

(56) References Cited

U.S. PATENT DOCUMENTS

| | | | | | |
|---|---|---|---|---|---|
| 2,965,238 | A * | 12/1960 | Sinclair | 211/69.9 |
| 3,045,987 | A * | 7/1962 | Cake | 366/110 |
| 3,128,082 | A * | 4/1964 | Cline | 366/210 |
| 4,373,632 | A * | 2/1983 | VanZandt | 206/457 |
| 4,793,666 | A * | 12/1988 | Torrence | 312/134 |
| 5,069,861 | A | 12/1991 | LaGarrigue | |
| 5,322,358 | A * | 6/1994 | Coho et al. | 366/214 |
| 5,399,013 | A * | 3/1995 | Sawyer | 366/211 |
| 2004/0155046 | A1* | 8/2004 | Gibson | 220/736 |
| 2007/0022644 | A1* | 2/2007 | Lynch et al. | 40/446 |
| 2007/0064522 | A1* | 3/2007 | Etheridge | 366/214 |
| 2007/0145868 | A1 | 6/2007 | Greiner | |
| 2011/0121697 | A1 | 5/2011 | Greiner | |

* cited by examiner

*Primary Examiner* — James Sanders

(74) *Attorney, Agent, or Firm* — Richard C. Vershave; Foster Pepper PLLC

(57) ABSTRACT

A nail polish display system includes a case, which may take the form of a shelving system or platform, sized to hold and display multiple bottles of nail polish. The bottles are attached to coupling devices, such as clamps, sleeves, magnetic couplers, etc. to an agitator, which preferably takes the form of a rotatable rod. A motor operates the agitator to move, rotate or otherwise agitate the bottles and therefore sufficiently and continuously mix the nail polish within the bottles. The system may include one or more sensors configured to detect the presence of a patron, configured to detect a position of the motor or agitator, and/or configured to detect when a door to the case is being opened. Further, the motor may be programmable and receive instructions from either a controller or control logic using input from one or more of the sensors.

22 Claims, 7 Drawing Sheets

NAIL POLISH DISPLAY SYSTEM

PRIORITY CLAIM

This application claims the benefit of the filing date of U.S. Provisional Patent Application No. 61/372,531 filed on Aug. 11, 2010, which is herein incorporated by reference in its entirety.

FIELD OF THE INVENTION

This invention relates generally to a nail polish display system, and more specifically to a nail polish display system operable to continuously agitate nail polish.

BACKGROUND OF THE INVENTION

Nail polish traditionally comes in clear bottles, which are usually made of glass and may be configured in a variety of shapes and sizes. The nail polish itself may come in many different colors. Regardless of the bottle shape or the polish color, one main objective is to catch the eye of a purchaser. Most often, this objective includes a point-of-sale display of different nail polish colors arranged on a multi-shelf or multi-platform system. For example, a beauty salon may have at least one point-of-sale display with various colors of a particular brand placed on shelves proximate a cashier.

In such a conventional shelving display, the nail polish bottle tends to sit on the shelf until an interested consumer picks up the bottle to better examine its contents. Nail polish, similar to wall paint, is made up of different chemical components having different densities, which means that over time the heavier components (usually related to the specific color of the polish) settle on the bottom of the bottle or at least begin to settle thus causing the ambient light to be perceived differently than if the polish was in a fully mixed state. Accordingly, it is quite common for the interested consumer to pick up the bottle and shake it to see the actual polish color. Quite often, the consumer shakes the bottle and the color changes, which in turn prompts the consumer to pick up and shake another bottle in an attempt to find a desired shade. While the consumer shaking process may appear to achieve the fully mixed state having the actual polish color, it is equally common for the consumer to agitate the bottle too much and cause air bubbles to form in the bottle. In some cases, the over-agitation may cause the bottle to break because manufactures typically insert a small ceramic or glass marble inside the bottle to help mix the polish. Likewise, the marble may also break due to over-agitation.

The air bubbles formed by over-agitation generally make it more difficult to smoothly apply the polish to a fingernail or toenail (hereinafter simply nail). While breakage of the bottle may be less common, breakage of the marble within the bottle leaves marble particulate inside the bottle and some of this particulate may be fine enough to be suspended in the polish. The suspended marble particulate may then be applied to the consumer's nail causing a granular or non-smooth finish.

SUMMARY OF THE INVENTION

A nail polish display system includes a case, which may take the form of a shelving system or platform, sized to hold and display multiple bottles of nail polish. The bottles are attached to coupling devices, such as clamps, sleeves, magnetic couplers, etc. to an agitator, which preferably takes the form of a rotatable rod. A motor operates the agitator to move, rotate or otherwise agitate the bottles and therefore sufficiently and continuously mix the nail polish within the bottles. The system may include one or more sensors configured to detect the presence of a patron, configured to detect a position of the motor or agitator, and/or configured to detect when a door to the case is being opened. Further, the motor may be programmable and receive instructions from either a controller or control logic using input from one or more of the sensors.

In one aspect of the invention, a nail polish display system for at least one nail polish bottle holding liquid nail polish includes a case; a coupling device for removably securing the nail polish bottle relative to the case; a rotating member connected to the coupling device; and a motor coupled to the rotating member, the motor configured to operate the rotating member to agitate the nail polish.

In one aspect of the invention, a method for displaying nail polish includes the steps of (1) attaching a bottle of nail polish to a coupling device connecting to a rotating member; (2) rotating the bottle of nail polish relative to a display structure, a rotational speed and spatial orientation of the bottle controllable by a programmable motor, the rotational speed selected to sufficiently agitate nail polish within the bottle; and (3) selectively halting the rotation of the bottle to make the bottle accessible in a desired orientation and location relative to the display structure.

In another aspect of the invention, a nail polish display system includes a coupling device configured to receivably retain a bottle of nail polish; an agitator connected to the coupling device; an actuation device configured to generate movement of the agitator sufficient to mix liquid nail polish within the bottle; and a first sensor in communication with the actuation device, the first sensor configured to detect motion.

BRIEF DESCRIPTION OF THE DRAWINGS

Preferred and alternative embodiments of the present invention are described in detail below with reference to the following drawings.

DETAILED DESCRIPTION OF THE PREFERRED EMBODIMENTS

The present invention generally relates, but is not limited, to a nail polish display system configured to rotate or otherwise agitate bottles of nail polish to maintain the polish in a sufficiently mixed state. In at least one embodiment, the nail polish display system includes a display case with agitators that hold one or more bottles of nail polish. The agitators and bottles may be arranged in a variety of configurations. A programmable motor may be used to drive the agitators, which may take the form of rotating members driven at a desired angular velocity. Coupling assemblies attached to the agitators may either support or clasp to the bottles. In one embodiment, the display case includes a touch or proximity sensor that signals the motor to stop when someone opens a door of the case, reaches inside the case, or makes some other detectable action to indicate that they want to handle one of the bottles of finger nail polish. Upon receiving such a signal either from the sensor or by way of a remote control, the motor may be commanded to move the agitators and thus position the bottles in a desired orientation, for example position the bottles oriented cap side up.

Figure 1:
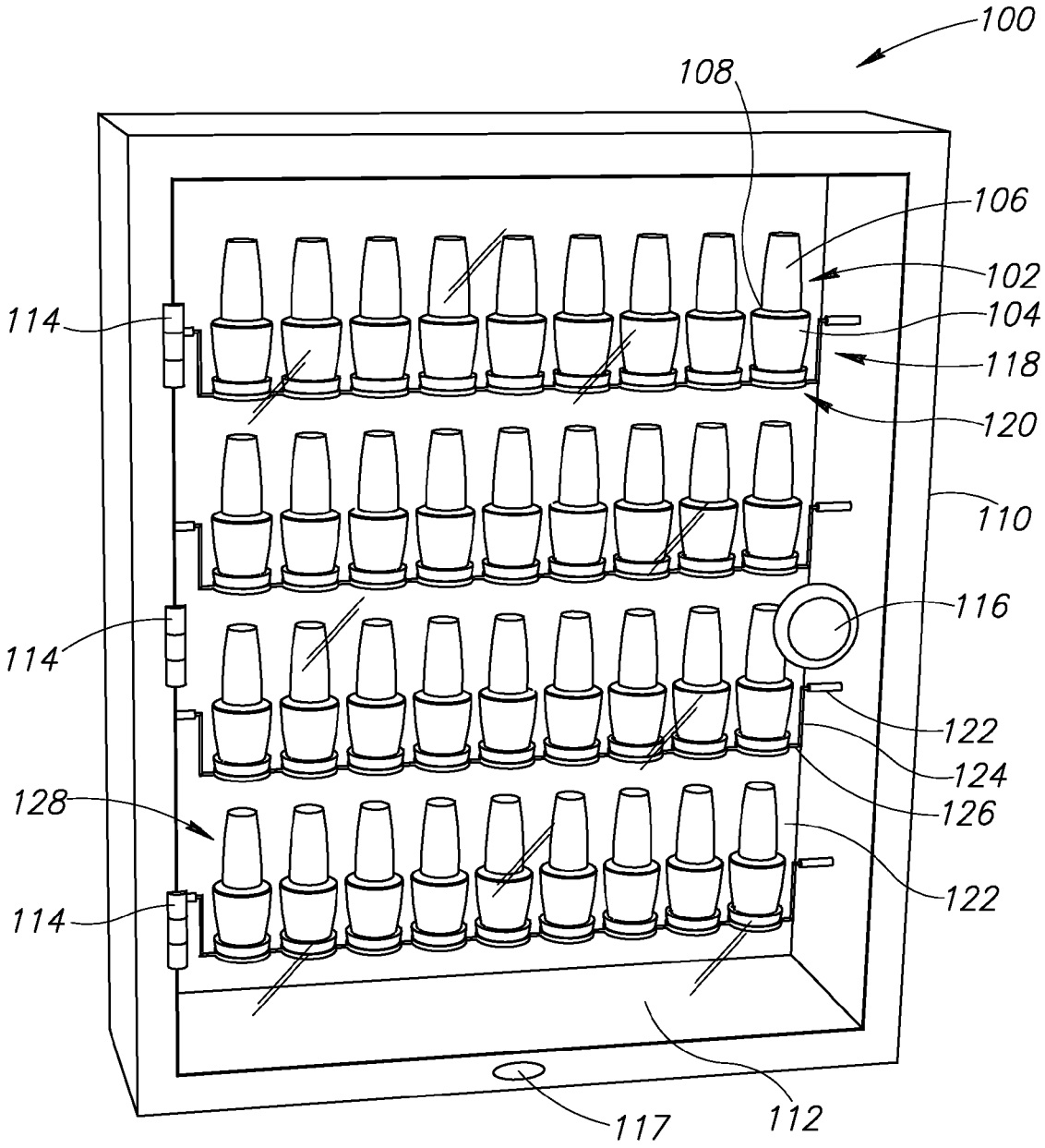
FIG. 1 is perspective view a nail polish display system having agitators coupled to bottles located within a case according to an embodiment of the present invention.

FIG. 1 shows a nail polish display system 100 for a plurality of bottles 102, each preferably containing a different color of nail polish (not shown). Each bottle 102 includes a polish-holding portion 104 and a cap portion 106, the latter typically being threaded onto the polish-holding portion 104. The bottle 102 may also include a neck portion 108. The bottles 102 are located generally within a case 110, which may have a transparent door 112 hingedly 114 attached to the case 110 according to one embodiment. A handle 116 may be coupled to the door 112 or the door may be spring and/or magnetically actuated to open and shut by pressing on the door 102. A sensor 117 may be located on a front of the case 110. The sensor 117 may take the form of a touch sensor, a proximity sensor or some other device capable of detecting the presence of a person in front of the case 110.

Figure 2:
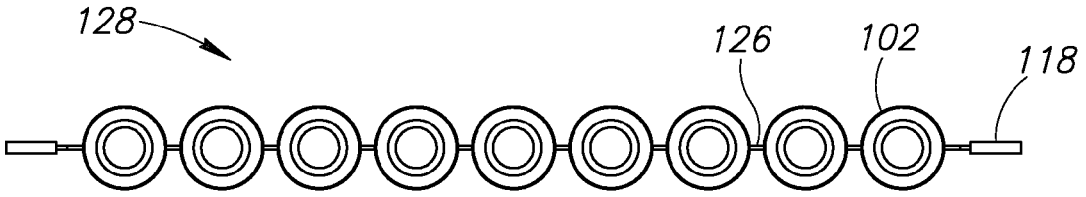
FIG. 2 is top plan view of the bottom row of bottles from FIG. 1.

An agitator 118 coupled to the case 110 may take the form of a rotatable rod attached to bottle-coupling assemblies 120. In the illustrated embodiment, the agitators 118 include a drive arm 122, an offset arm 124 and a bottle-support portion 126. FIG. 2 shows a top, plan view of the bottles 102 arranged in a lower row 128 of the case 110 of FIG. 1, but with the case structure removed for purposes of clarity.

Figure 3:
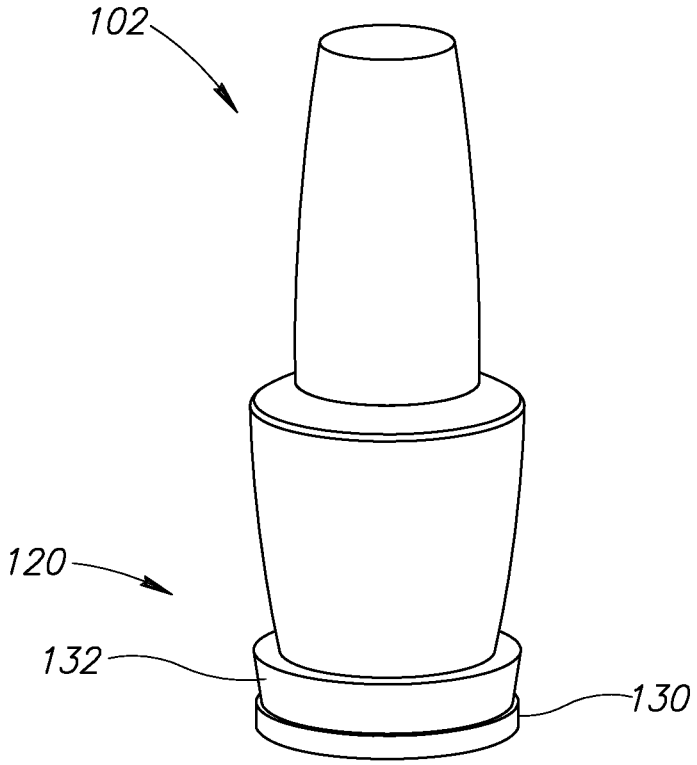
FIG. 3 is side, perspective view of a nail polish bottle retained by a coupling device according to an embodiment of the present invention.
Figure 4:
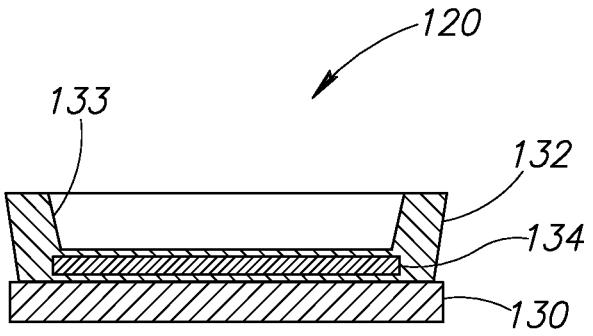
FIG. 4 is a cross-sectional view of the coupling device of FIG. 3 according to an embodiment of the present invention.

FIGS. 3 and 4 show the bottle-coupling assembly 120 according to an embodiment of the present invention. The assembly 120 includes a base member 130 connectable to a sleeve member 132. The base member 130 is fixed to the agitator 118. In the illustrated embodiment, the sleeve member 132 is configured to closely receive the bottle 102. The sleeve member 132 may include an elastomeric, foam or synthetic liner, insert or seal 133 that suctions to the bottle 102. In addition, the sleeve member 132 may include a magnetic plug 134 preferably embedded into the sleeve member 132. Alternatively, the sleeve member 132 itself may be made from an iron-based substance and thus be magnetizable. Similarly, the base member 130 may also be made from a magnetizable material or include a magnetizable plug (not shown). In use, an interested person would select and remove a bottle 102 from the case 110 and the sleeve member 132 would stay attached to the bottle 102. The person could examine the bottle 102; sample its contents, etc. Upon placing the bottle 102 back in the case 110, the magnetic attraction between the base member 130 and sleeve member 132 would urge the bottle 102 back into place on the agitator 118.

Figure 5:
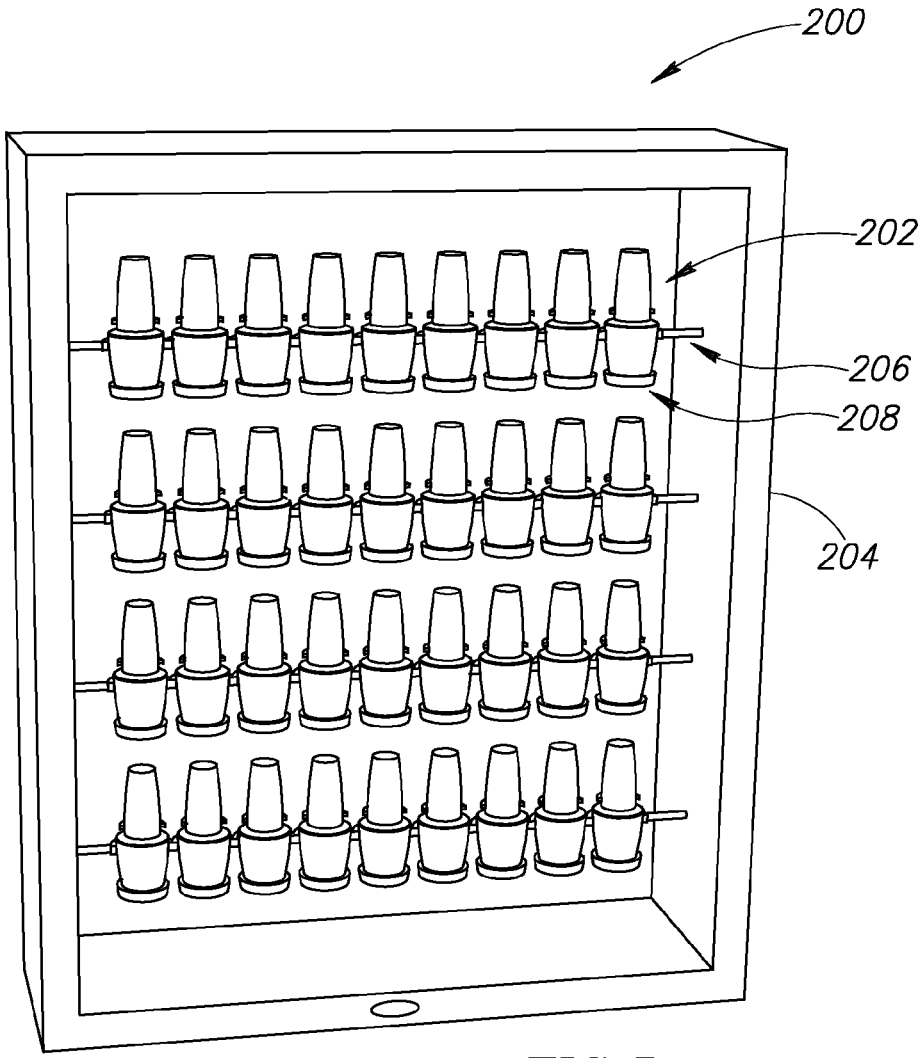
FIG. 5 is a perspective view of a nail polish display system having coupling device according to another embodiment of the present invention.
Figure 6:
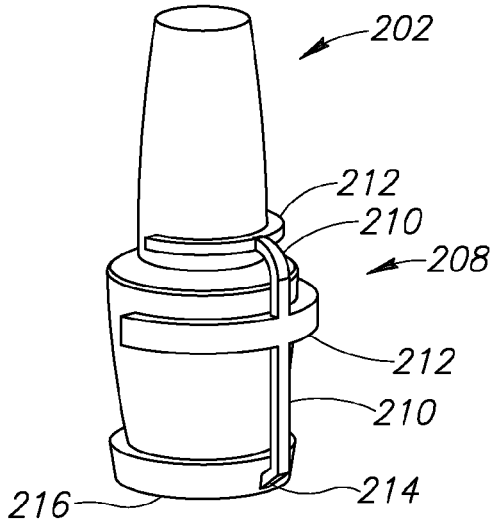
FIG. 6 is a rear perspective view of one of the coupling devices from FIG. 5 connected to a finger nail polish bottle according to an embodiment of the present invention.

FIG. 5 shows another display system 200 having bottles 202 arranged in a case 204. The display system 200 may include many of the same aspects of the display system 100 as described above, but these same or similar components are not described in detail herein for purposes of brevity and may not be illustrated for purposes of clarity. In the illustrated embodiment, the system 200 includes agitators 206 and bottle-coupling assemblies 208. As best shown in FIG. 6, each bottle-coupling assembly 208 includes a spine member 210 coupled to bottle support members 212 and a leverage member 214, which in turn may be coupled to a base member 216. The bottle support members 212 are configured to closely receive the polish-holding and cap portions, respectively. Moreover, at least one of the bottle support members 212 may provide a clamping action on the bottle 202. The leverage member 214 may be welded, bonded or otherwise attached to the base member 216.

Figure 7:
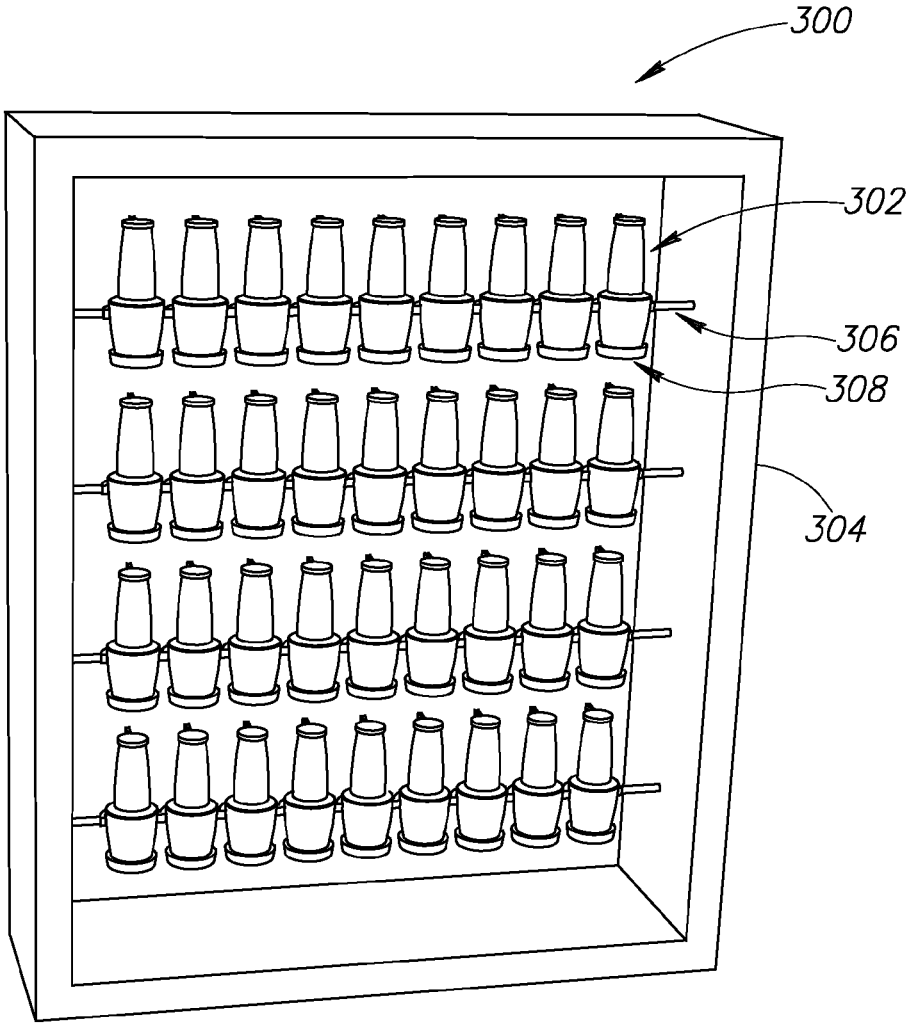
FIG. 7 is a perspective view of a nail polish display system having coupling device according to another embodiment of the present invention.
Figure 8:
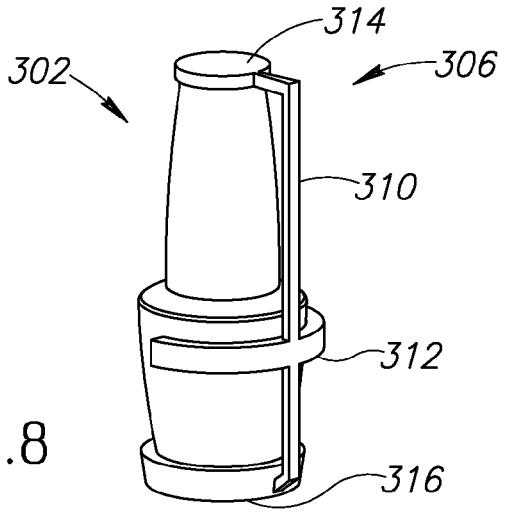
FIG. 8 is a rear perspective view of one of the coupling devices from FIG. 7 connected to a finger nail polish bottle according to an embodiment of the present invention.

FIGS. 7 and 8 show yet another display system 300 having bottles 302 arranged in a case 304. The display system 300 may include many of the same aspects of the display system 100 as described above, but these same or similar components are not described in detail herein for purposes of brevity and may not be illustrated for purposes of clarity. In the illustrated embodiment, the system 300 includes agitators 306 and bottle-coupling assemblies 308. As best shown in FIG. 8, each bottle-coupling assembly 308 includes a spine member 310 coupled to a bottle support member 312 and to end-cap members 314, 316 (top and bottom, respectively). The bottle support member 312 is configured to closely receive the polish-holding, neck or cap portion of the bottle 302. The spine member 310, bottle support member 312, and end-cap members 314, 316 may take the form of a one-piece component or may be attached together by welding, bonding or some other mechanical process.

Figure 9:
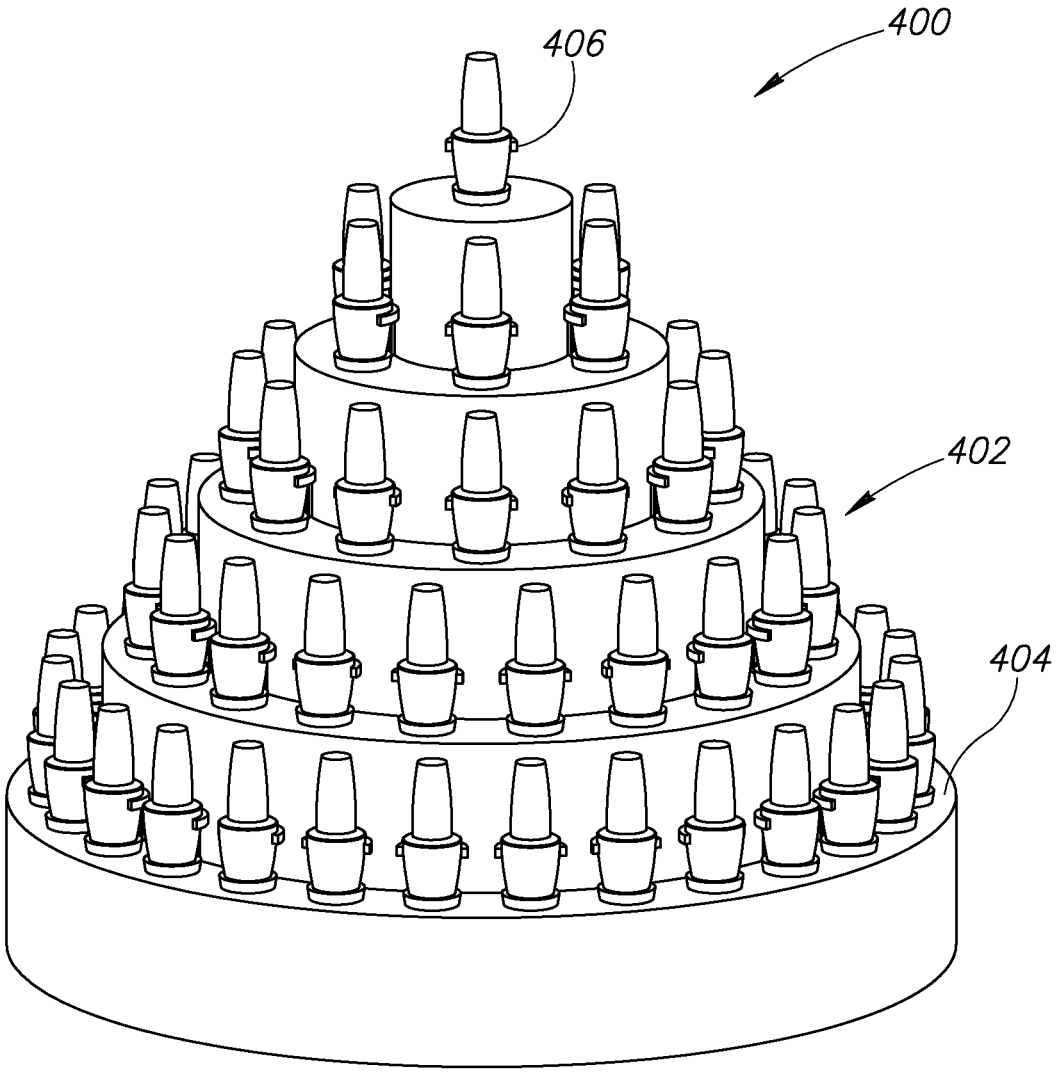
FIG. 9 is a perspective view of a nail polish display system according to yet another embodiment of the present invention.

FIG. 9 shows yet another display system 400. In the illustrated embodiment, bottles 402 are arranged on a plurality of tiered surfaces 404. The bottles 402 are held by coupling members 406, which in turn are actuated by agitators (not shown). To mix the polish in the bottles 402, the surfaces 404 may be telescoped such that they may be lowered and then the bottles rotated in either a clockwise or counterclockwise direction. A motor (not shown) for moving the agitators may also be coupled to a gearbox that moves the surfaces 404.

The cases described above may take a variety of forms and shapes, they may be wall mounted or placed on a surface, such as a countertop, desk or floor. The cases may be made out of virtually any material, for example, wood, plastic, metal, etc. In one embodiment, a backing for the case may be a mirrored surface for aesthetic reasons. While the cases may have doors, such doors may take a variety of forms such as hinged doors, sliding doors, etc. A light source such as a light bulb or light emitting diode may be located within the case to provide a desired amount of lighting.

Figure 10:
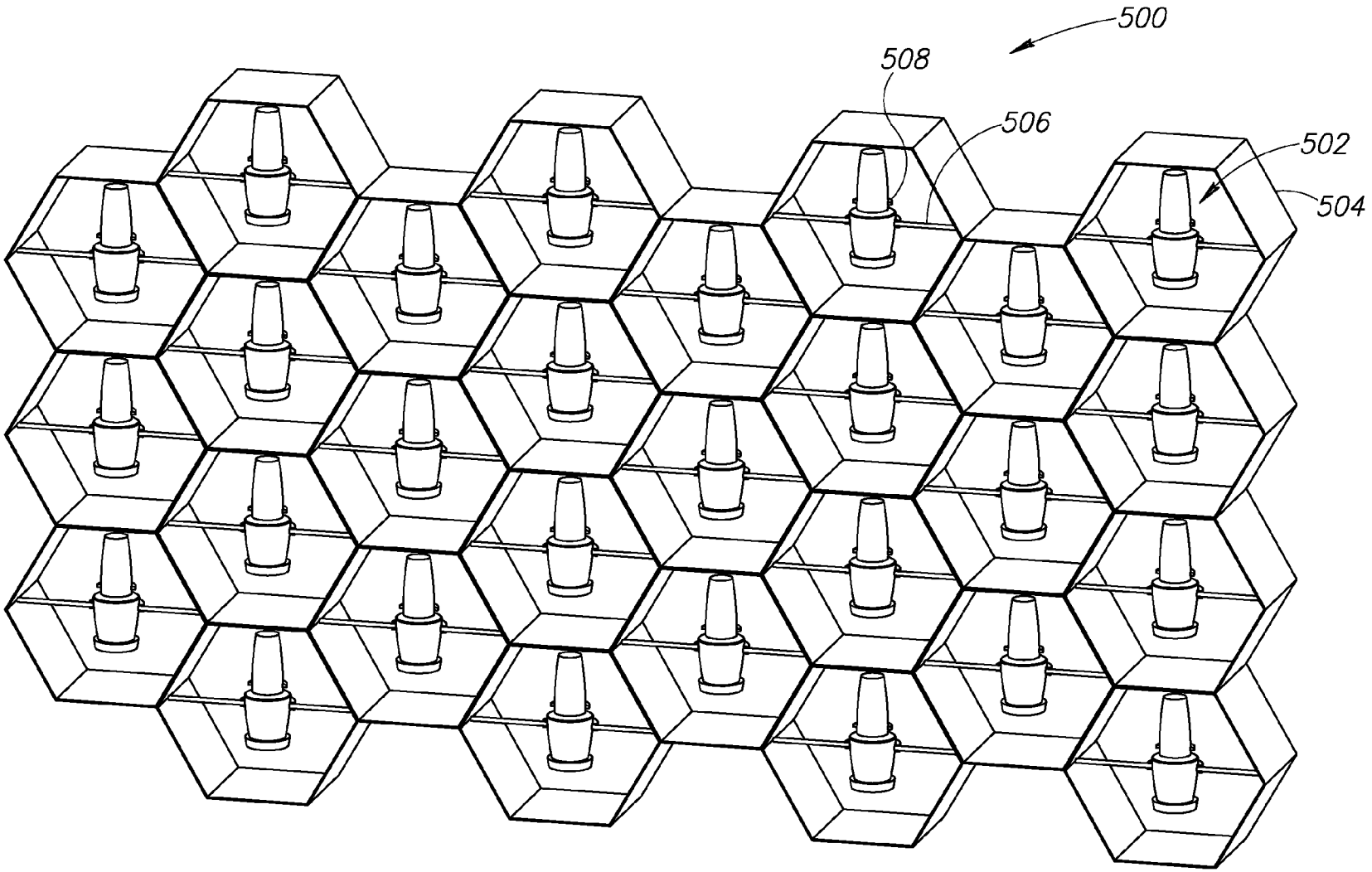
FIG. 10 is a perspective view of a nail polish display system according to still another embodiment of the present invention.

FIG. 10 shows yet another display system 500 in which bottles 502 are coupled to individual cases 504. In turn, the cases 504 may be rotated with the bottles 502 fixed thereto or the bottles 502 may be rotated within each static case 504. The bottles 502 are coupled to the cases 504 using attachment rods 506 in cooperation with coupling devices 508. The shapes and arrangement of the cases 504 may take many forms. Further, the rods 506 may be removable and replaceable and/or interchangeable with different styles, shapes, contours, etc.

Figure 11:
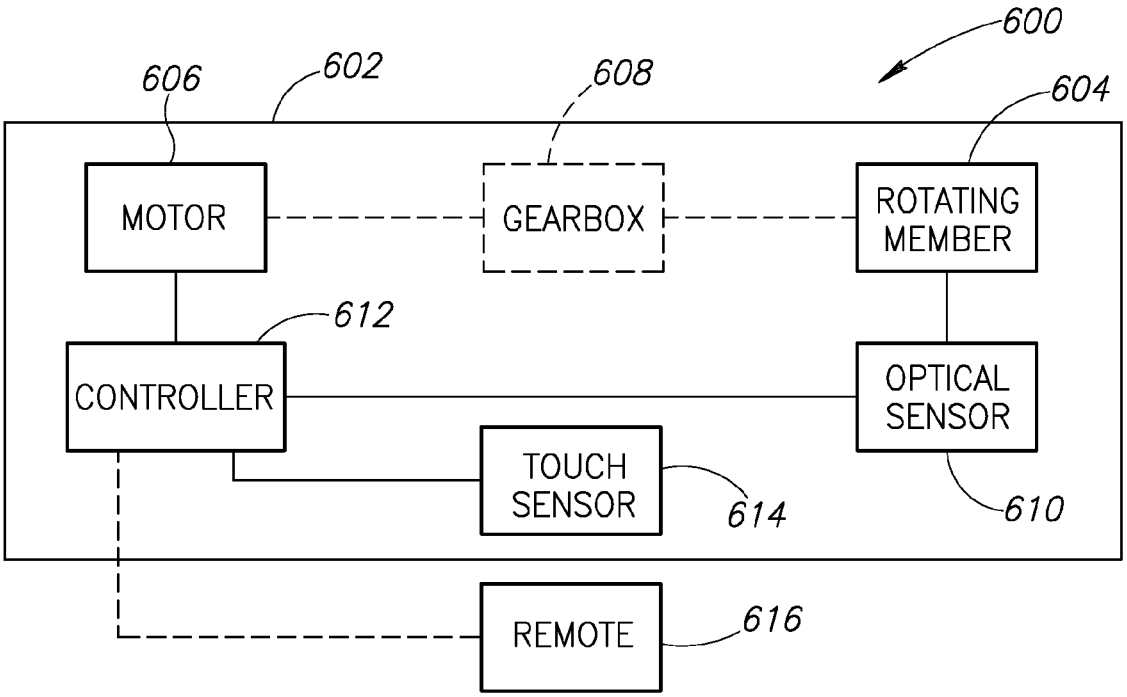
FIG. 11 is a block diagram of a nail polish display system according to an embodiment of the present invention.

FIG. 11 shows a block diagram 600 of a display system 602. As described above, the display system 602 includes some form of a case with bottles of finger nail polish. By way of example, each bottle is coupled to a rotating member 604, which is moved through operation of a motor 606. Optionally, a gearbox 608 or equivalent mechanism may be employed to reduce, increase or otherwise modify the speed of the rotating member 604. An optical sensor 610 may be positioned to detect a rotational position of the rotating member 604 and this positional information communicated to a controller or microprocessor 612. By knowing the rotational position of the rotating member 604, the motor may be controlled to move the bottles into a desired position and/or orientation when a touch sensor 614 is triggered by a patron or employee.

For example and briefly referring to FIGS. 1 and 11, a patron may trigger the touch sensor 117/614, which in turns provides a signal to the controller/processor 612. The optical sensor 610 correspondingly provides the rotational position of the rotating members 604 to the controller 612, which in turn commands the motor 606 to move the bottles into an upright position for removal by the patron. Alternatively, the case may be maintained in a locked configuration inaccessible by a patron until an employee commands the case to open using a remote control device 616. So if a patron wants to sample a bottle of nail polish, the employee sends a signal using the remote 616, which opens the case, provides a signal to the controller 612, and consequently operates the motor 606 to move the rotating members 604 into the desired position and/or orientation. In one embodiment, the rotating members 604 may be configured to make the bottles continue to rock slowly rather than come to a complete stop after the touch sensor 614 is triggered.

Figure 12:
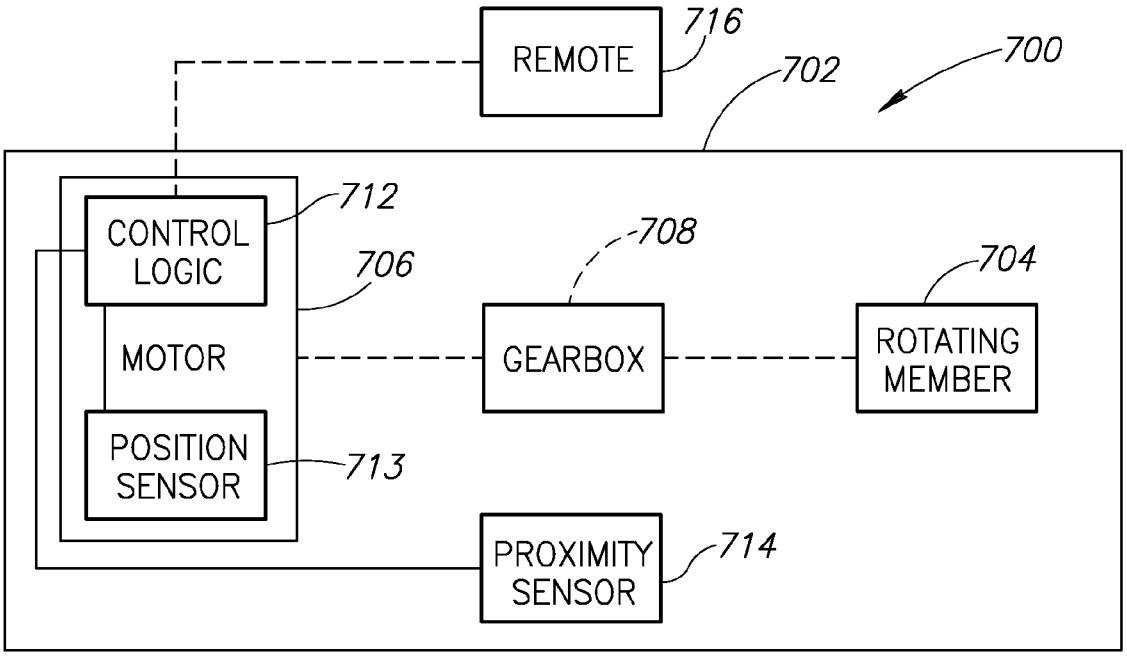
FIG. 12 is a block diagram of a nail polish display system according to another embodiment of the present invention.

FIG. 12 shows a block diagram 700 of a display system 702. Like components already described, specifically the rotating member 704, the optional gearbox 708, and the remote control device 716, are not be re-described herein. The system 702 includes a proximity sensor 714 to detect a presence of a person near the system 702, for example the presence of a patron ready to open a door on the display case. The proximity sensor 714 may take a variety of forms and may be located in a variety of places on the case. The rotational speed and position of the rotating member 704 is controlled by a motor 706 having motor control logic 712 in cooperation with a position sensor 713. The position sensor 713 determines a rotational position of a motor shaft or some other motor component and then provides this rotational position information to the control logic 712. In one embodiment, the motor 706 takes the form of a stepper motor and operates to quickly rotate the rotating member 704 either clockwise or counterclockwise to position the bottles in the desired position and/or orientation relative to the case.

The inclusion of the motor and controller or control logic permits the bottles to be positioned and oriented in a manner that makes them aesthetically pleasing and readily accessible. The motor may be programmable to modify the agitation speed of the bottles, the rotational direction, etc. The remote can be used to stop the rotation of the bottles from a distance. Alternatively, a sensor may be positioned on the case to detect movement by an interested patron. Upon sensing such movement, the sensor communicates with the controller or control logic, which in turn instructs the motor to stop rotating the bottles so the patron may view and possibly remove the nail polish bottles when they are in an upright position. To prevent the patron from waiting too long, the motor may be commanded to accelerate in the same or reverse direction to orient the bottles within milliseconds of the movement detected by the sensor. In another embodiment, the controller or control logic may include a timing module that instructs the motor to restart after a set period of time. The set period of time may be a certain time after the door to the case has been closed, in which such closure may be detected by a contact sensor, or a certain time after no more movement is detected by the proximity sensor on the case.

While the illustrated embodiments show cases with multiple bottles and rotating members, it is appreciated that the invention may be a case configured to hold and agitate a single bottle. Such a case may be advantageous at a technician's work station or by individuals in their home. While the technician or individual is preparing nails for painting, they can place the nail polish bottle into the case and then allow the bottle to be agitated for an adequate amount of time to sufficiently mix up the polish. Once the polish is mixed, the bottle will stop agitating and the technician/individual will know the polish is now ready for use.

While the preferred embodiments of the invention have been illustrated and described, as noted above, many changes can be made without departing from the spirit and scope of the invention. Accordingly, the scope of the invention is not limited by the disclosure of the preferred embodiments. Instead, the invention should be determined entirely by reference to the claims that follow.

The embodiments of the invention in which an exclusive property or privilege is claimed are defined as follows:

1. A nail polish display system for at least one nail polish bottle holding liquid nail polish, the system comprising:

a case;

a coupling device for removably securing the nail polish bottle relative to the case;

a rotating member connected to the coupling device;

a motor coupled to the rotating member, the motor configured to operate the rotating member to agitate the nail polish; and a sensor for determining the rotational position of the rotating member, the sensor communicating this information to a controller to control the motor to move the at least one bottle into a desired orientation.

2. The nail polish display system of claim 1, wherein the motor is housed within the case.

3. The nail polish display system of claim 1, wherein the motor is a stepper motor.

4. The nail polish display system of claim 1, further comprising a programmable controller in communication with the motor.

5. The nail polish display system of claim 4, wherein the programmable controller instructs the motor to rotate the rotating member at a desired rotational velocity sufficient to agitate the nail polish.

6. The nail polish display system of claim 4, wherein the programmable controller is configurable to halt rotation of the rotating member when the nail polish bottle is in an upright orientation.

7. The nail polish display system of claim 1, further comprising a remote control in wireless communication with the motor.

8. The nail polish display system of claim 1, wherein the coupling device includes a resilient clamp configured to receive a neck portion of the bottle.

9. The nail polish display system of claim 1, wherein the coupling device includes a first magnet of a first polarity attachable to the bottle and a second magnet of an opposite polarity coupled to the rotating member.

10. The nail polish display system of claim 1, further comprising a sensor located on a front of the display case, the sensor operable to provide a signal to the motor for commanding the motor to move the rotating member to desired position and stop the rotating member for a desired amount of time.

11. The nail polish display system of claim 10, wherein the sensor is a touch sensor located on a front of the case.

12. The nail polish display system of claim 10, wherein the sensor is a proximity sensor located on a front of the case.

13. A method for displaying nail polish, the method comprising:

attaching a bottle of nail polish to a coupling device connecting to a rotating member;

rotating the bottle of nail polish relative to a display structure, a rotational speed and spatial orientation of the bottle controllable by a programmable motor, the rotational speed selected to sufficiently agitate nail polish within the bottle; and selectively halting the rotation of the bottle to make the bottle accessible in a desired orientation and location relative to the display structure;

wherein a sensor determines the rotational position of the rotating member and communicates this information to the programmable motor to control the motor to move the bottle into the desired orientation and location relative to the display structure.

14. The method of claim 13, wherein attaching the bottle includes suctioning the bottle into a sleeve of the coupling device.

15. The method of claim 13, wherein selectively halting the rotation includes receiving a signal from a proximity sensor, the signal provided to a controller in communication with the motor.

16. A nail polish display system comprising:

a coupling device configured to receivably retain a bottle of nail polish;

an agitator connected to the coupling device;

an actuation device configured to generate movement of the agitator sufficient to mix liquid nail polish within the bottle; and a first sensor in communication with the actuation device, the first sensor configured to detect motion;

wherein the first sensor is configured to detect motion of a portion of the actuation device and communicate this information to a controller to control the activation device to move the bottle into a desired orientation.

17. The nail polish display system of claim 16, wherein the first sensor is configured to detect motion of a person in proximity to the display system.

18. The nail polish display system of claim 16, wherein the coupling device includes a clamping device.

19. The nail polish display system of claim 16, wherein the agitator includes a rotatable rod coupled to the actuation device.

20. The nail polish display system of claim 16, wherein the actuation device includes a motor.

21. The nail polish display system of claim 16, wherein the coupling device includes a clamping device.

22. The nail polish display system of claim 16, further comprising a second sensor configured to detect an opening of a door relative to a case of the system.

* * * * *